United States Patent [19]

Kelley

[11] Patent Number: 5,008,084

[45] Date of Patent: Apr. 16, 1991

[54] INSULATED CONTAINER FOR BIOLOGICAL SAMPLES

[75] Inventor: Louis E. Kelley, Wyncote, Pa.

[73] Assignee: Instruments for Research and Industry I²R, Inc., Cheltenham, Pa.

[21] Appl. No.: 565,939

[22] Filed: Aug. 13, 1990

[51] Int. Cl.[5] ..... B01L 3/00

[52] U.S. Cl. ..... 422/102; 422/104; 220/410; 220/411; 220/412; 220/413

[58] Field of Search ..... 422/102, 104, 72, 300; 220/411, 412, 413, 410, 444, 528, 454, 902

[56] References Cited

U.S. PATENT DOCUMENTS 3,389,824 6/1968 Burchtold ..... 220/902

3,432,666 3/1969 Nash et al. ..... 220/454

*Primary Examiner*—David L. Lacey

*Assistant Examiner*—Laura E. Collins

*Attorney, Agent, or Firm*—paul Lipsitz

[57] ABSTRACT

An insulated container for keeping enzymes and biological materials held in microfuge tubes cold for an extended period of time which comprises a container having a central core made of metal (preferably of aluminum), which has receptacles for microfuge tubes and the container also having thermal insulation between the core and the inside surface of the container. The bottom of the container may be recessed to mitigate heat conductance from a laboratory bench top. A lid or cover which fits inside the top of the container is optional.

10 Claims, 2 Drawing Sheets

INSULATED CONTAINER FOR BIOLOGICAL SAMPLES

This invention relates to an insulated container and, in particular, a container for keeping biological samples cold after transfer from a freezer to a workbench.

BACKGROUND OF THE INVENTION

In working with enzymes and other biological samples, it is necessary to remove these enzymes or other material from a freezer (−20° C. or below) and then blend them with the biological specimens in the course of experimental procedures. In use, it is a common practice to remove a number of such filled enzyme containing tubes from the freezer and place then in a holding rack where they must remain cold. In order to keep the contents of the microtubes cold, the rack holding them is often placed in an ice bath, but this arrangement may not be satisfactory for several reasons. First of all, the use of an ice bath is untidy, leaving the tubes wet and requiring additional handling. Second, the presence of the water on the tubes may cause contamination and, furthermore, an ice bath often does not keep the contents of the tubes as cold as needed for the operations to which they are subjected. This invention provides means to obviate the above problems.

DISCUSSION OF THE PRIOR ART

Insulated containers such as disclosed in U.S. Pat. No. 3,221,915 are known in the prior art, but no such container relevant to this invention is known.

BRIEF STATEMENT OF THE INVENTION

The invention provides an insulated container for keeping enzymes, biological and other related materials stored in microfuge tubes at tempertures below 0° C. for an extended time and comprises a container having a central metal core, preferably of aluminum, which has receptacles adapted to hold microfuge tubes and thermal insulation surrounding the aluminum core. A top cover which fits within the top of the container is an optional feature.

The samples of enzymes or biological materials in the microfuge tubes are simply placed in holes or receptacles of the insulated container which is itself held in a freezer until the tubes are ready for use. Upon removal, the insulated container of the invention maintains the tubes and their contents at the desired low temperature until the experimental procedures are completed and the contents are returned to the freezer.

DETAILED DESCRIPTION OF THE INVENTION

Figure 1:
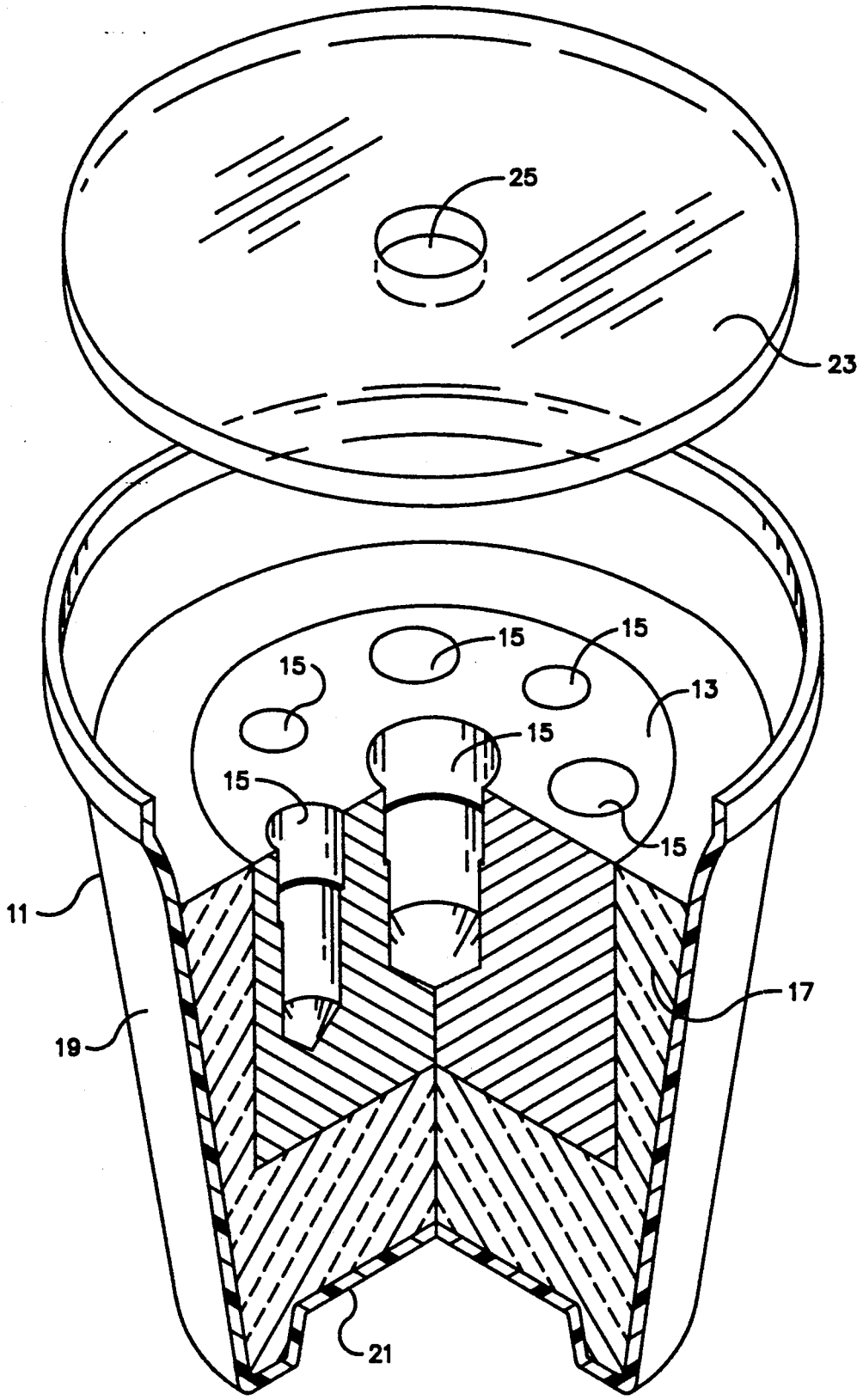
FIG. 1 is a front cut-away view of the container of the invention.

Referring now to FIG. 1, the insulated container of the invention is shown in a cut-away view and is indicated generally as 11. An aluminum core 13, preferably cylindrical, contains a multiplicity of holes or receptacles 15 adapted in shape to receive microfuge tubes (not shown). As indicated in FIG. 1, the receptacles may vary in size so that microfuge tubes of various sizes may be accommodated. The aluminum core 13 is readily obtained by machining a solid aluminum cylinder of the appropriate size and the receptacles in the core are readily made by drilling the core with appropriately sized drill bits. As shown, the aluminum core is adapted to hold the microfuge tubes in a vertical position.

Surrounding the aluminum core 13 is a thermal insulator 17 which is preferably made of a thermally insulting foamed material such as polystyrene, polyurethane, and the like. Foamed polyurethane is the preferred insulating material. The foamed insulator 17 may be cut to size from a previously foamed piece or, preferably, is foamed in place between the aluminum core and the inner surface of the cup-like container 19. The thickness of the insulation may vary and will, of course, depend upon the size of the container and the insulation used. For a container having a top diameter of about four inches and using foamed polyurethane as insulation, the thickness of the insulation will be about one-half inch.

The container 19 may be made of any suitable material, but will be preferably a plastic material and most preferably will be made from an ABS resin (i.e., acrylonitrile-butadiene-styrene) which is well known in the art. Optionally and preferably, the container 19 will have a centrally recessed bottom 21 to provide less surface contact with a warm bench top and thereby provide air insulation for the bottom of the container and mitigate the conductance of heat through the bottom.

A cover 23 which fits inside the top rim of container 19 is a desirable option as the cover helps to prevent frost build-up when the container is out of the freezer and also permits stacking of the containers in the freezer. A central hole 25 in the cover enables the cover to be easily handled and lifted off the container. The cover 23 is preferably made of plastic such as clear acrylic plastic.

Figure 2:
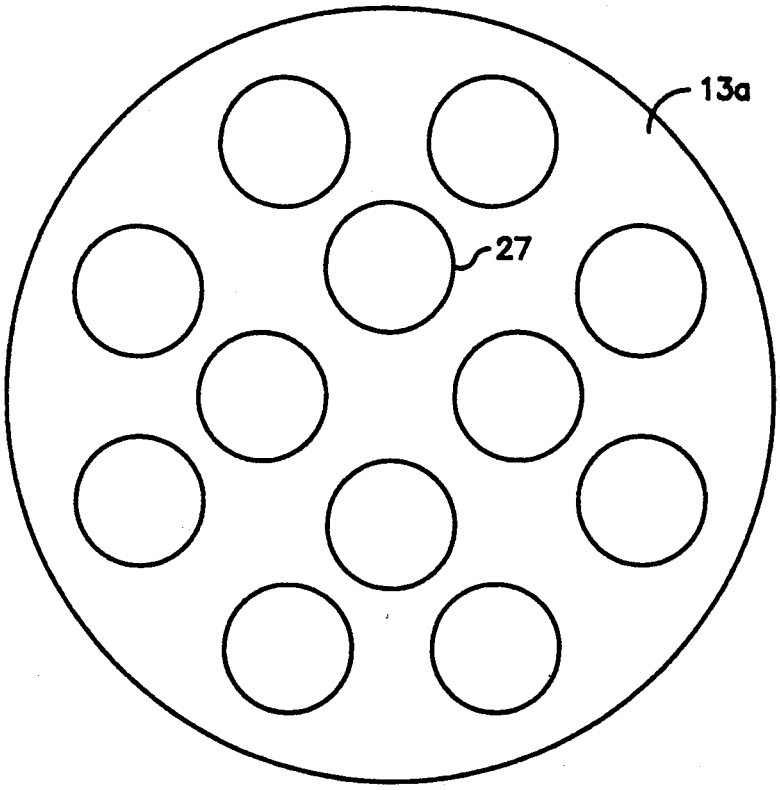
FIG. 2 is a top view of an alternative embodiment of the receptacle holes for microfuge tubes.

As shown in FIG. 1, the receptacles 15 may vary in size to accomodate differently sized microfuge tubes. The number of receptacles may also vary. The peripheral receptacles shown in FIG. 1 will accommodate 0.5 ml. and 1.5 ml. microfuge tubes and the central large receptacle will accommodate an enzyme vial. FIG. 2 shows in top view an alternative embodiment for the receptacles to hold the microfuge tubes where the core **13*a* is adapted to have twelve receptacles 27** of uniform size.

As indicated above, use of the insulated container of the invention provides a convenient and easy way of keeping cold enzymes and other biological samples in microfuge tubes after they have been transferred from the freezer to the workbench. In addition, the container of the invention eliminates the inconvenience of a messy ice bath. The aluminum core of the container provides a large thermal mass which keeps the contents of the microfuge tubes below 0° C. for 40 minutes or more after the container has been removed from a −20° C. freezer. The layer of insulation between the core and the inside surface of the container both insulates the core from the heat of the work-room and such construction also allows the container to be handled without gloves. The preferred materials of construction of the insulated container as described above are unaffected by low temperature and enable the device to be used at temperatures as low as about −78° C.

What is claimed is:

1. An insulated container comprising a container having a central metal core, said core having a multiplicity of drilled holes constructed so as to receive a multiplicity of microfuge tubes in said core and foamed thermal insulation surrounding said core.

2. The container of claim 1 wherein said metal is aluminum and said insulation is a foamed polyurethane.

3. The container of claim 2 wherein said container is made of acrylonitrile-butadiene-styrene resin.

4. The container of claim 3 wherein the drilled holes are constructed so as to hold a multiplicity of microfuge tubes of various sizes.

5. The container of claim 1 in combination with a top cover.

6. The container of claim 4 wherein the bottom of the container is recessed.

7. An insulated container comprising a container having a cylindrical aluminum core containing a plurality of drilled holes constructed so as to receive microfuge tubes in said holes and thermal insulation between said aluminum core and the inner surface of said container.

8. The container of claim 7 wherein said insulation is foamed polyurethane or foamed polystyrene and said container is made of acrylonitrile-butadiene-styrene resin.

9. The container of claim 8 wherein the bottom of the container is recessed.

10. The container of claim 9 in combination with a top cover.

* * * * *